US005893593A

United States Patent [19]

Dowling

[11] Patent Number: 5,893,593

[45] Date of Patent: Apr. 13, 1999

[54] LATCH DEVICE USED IN VEHICLE DOOR

[75] Inventor: Patrick J. Dowling, Yamanashi-ken, Japan

[73] Assignee: Mitsui Kinzoku Kogyo Kabushiki Kaisha, Tokyo, Japan

[21] Appl. No.: 08/890,428

[22] Filed: Jul. 9, 1997

[30] Foreign Application Priority Data

Jul. 10, 1996 [JP] Japan ..... 8-199823

[51] Int. Cl.[6] ..... E05B 3/00

[52] U.S. Cl. ..... 292/336.3; 292/169.11; 292/216; 292/DIG. 46; 292/DIG. 53

[58] Field of Search ..... 292/336.3, 169.11, 292/DIG. 46, DIG. 27, 216, DIG. 65, DIG. 53

[56] References Cited

U.S. PATENT DOCUMENTS

| | | | |
|---|---|---|---|
| 3,923,329 | 12/1975 | Torii et al. | 292/216 |
| 4,487,441 | 12/1984 | Miyamoto et al. | 292/336.3 |
| 4,492,395 | 1/1985 | Yamada | 292/216 |
| 4,662,109 | 5/1987 | Yui et al. | 49/214 |
| 4,969,673 | 11/1990 | Portelli et al. | 292/216 |
| 4,995,654 | 2/1991 | Nishigami et al. | 292/216 |
| 5,035,453 | 7/1991 | Fukumoto et al. | 292/336.3 |
| 5,052,731 | 10/1991 | Hayakawa et al. | 292/336.3 |
| 5,234,237 | 8/1993 | Gergoe et al. | 292/201 |
| 5,308,128 | 5/1994 | Portelli et al. | 292/216 |
| 5,605,363 | 2/1997 | Kapes | 292/196 |
| 5,618,068 | 4/1997 | Mitui et al. | 292/201 |
| 5,685,579 | 11/1997 | Funk et al. | 292/216 |
| 5,702,136 | 12/1997 | Funk et al. | 292/336.3 |

FOREIGN PATENT DOCUMENTS

| | | |
|---|---|---|
| 7-82939 | 3/1995 | Japan . |
| 0791080 | 2/1958 | United Kingdom . |

*Primary Examiner*—Steven Meyers
*Assistant Examiner*—Clifford B. Vaterlaus
*Attorney, Agent, or Firm*—Browdy & Neimark

[57] ABSTRACT

A relay assembly for a vehicle sliding door comprises an outer opening lever mounted on a base plate for releasing a latch unit by operation of an outside open handle, a locking lever mounted on the base plate and having an unlocked position and a locked position, an inner opening lever mounted on the base plate for releasing the latch unit by operation of an inside open handle, a child-proof lever mounted on the base plate and having a non-proof position and a proof position, and a ratchet lever mounted on the base plate and coupled to the latch unit through a rod or wire. The locking lever and child-proof lever are pivotally mounted on the base plate by a first shaft, and are provided on opposite sides of the base plate, respectively. The inner opening lever and outer opening lever are pivotally mounted on the base plate by a second shaft parallel to the first shaft, and are provided on opposite sides of the base plate, respectively.

10 Claims, 11 Drawing Sheets

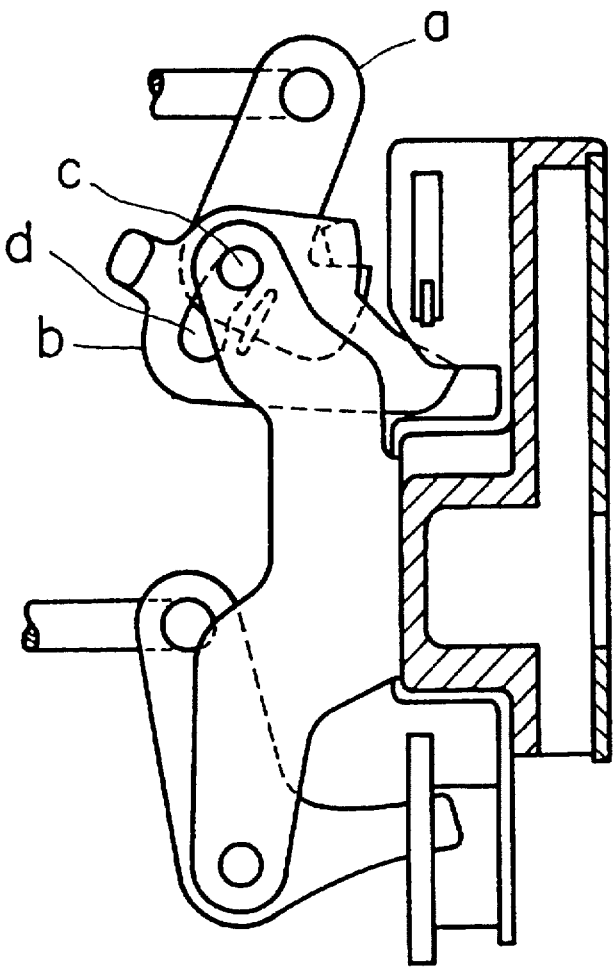
FIG. 1
(PRIOR ART)
FIG. 2
(PRIOR ART)
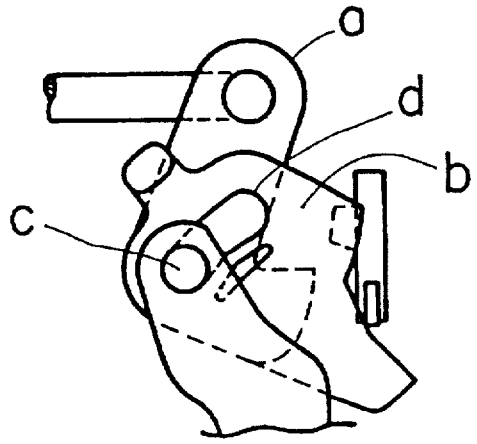

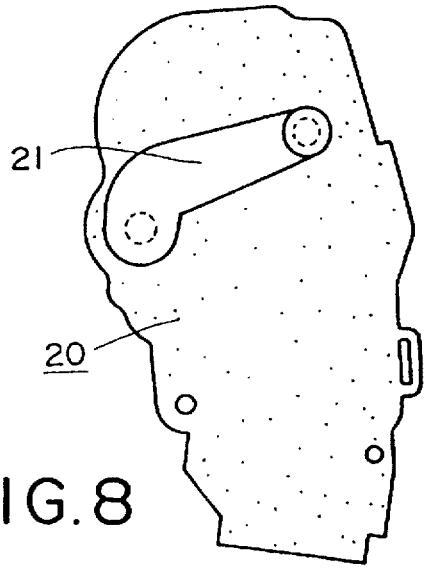
FIG. 8
FIG. 9
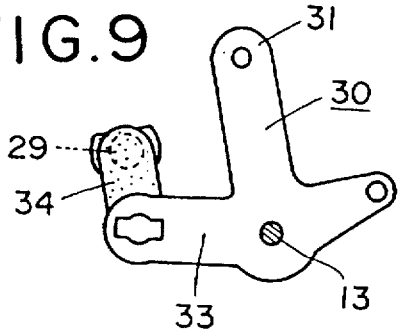
FIG. 10
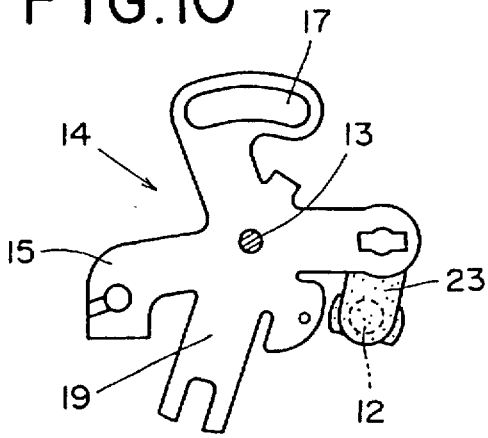
FIG. 11
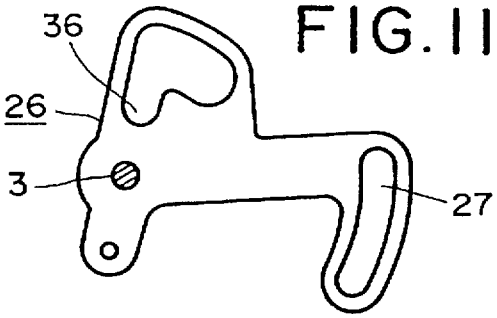
FIG. 12
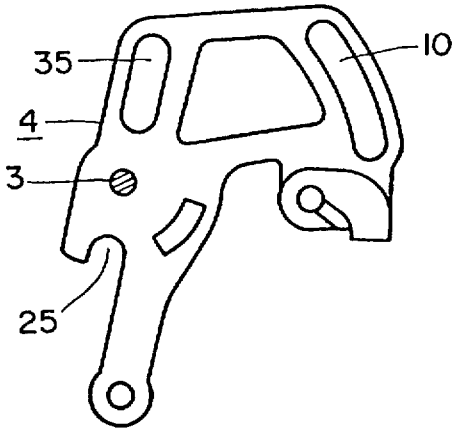
FIG. 13
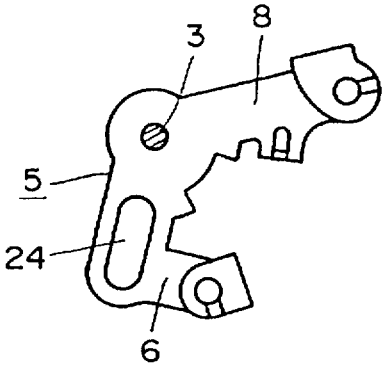

LATCH DEVICE USED IN VEHICLE DOOR

BACKGROUND OF THE INVENTION

The present invention relates to a latch device used in a vehicle door, and in particular to a compact latch device having a door opening mechanism, a locking mechanism and a child-proof mechanism.

RELATED ART

A conventionally well-known latch device for holding a vehicle door in a closed condition incorporates therein a latch unit which has a latch adapted to be engaged with a striker fixed to a vehicle body, and a ratchet for holding the engagement between the latch and the striker; a door opening mechanism which has a ratchet lever coupled to the ratchet of the latch unit, and outer and inner opening levers coupled to outside and inside open handles of the door, respectively, for rotating the ratchet lever so as to release the latch unit; and a locking mechanism which has a locking lever coupled to an inside button of the door for disabling opening operation of the opening mechanism. Further, the well-known latch device may optionally incorporate a child-proof mechanism which has a child-proof lever for disabling opening operation of the inner opening lever.

The above-mentioned mechanisms are in general attached to a latch body of the latch unit for housing therein the latch and the ratchet in a swing type door, but are attached at a place distant from the latch body if the door is of a slide type.

The levers in the mechanisms are supported with the use of a plurality of shafts. For example, a latch device disclosed in U.S. Pat. No. 4,487,441 comprises a first shaft (60) for supporting an outer opening lever (58), a second shaft (54) for supporting an inner opening lever (52), a third shaft (34) for supporting a locking lever (32), a fourth shaft (42) for supporting a child-proof lever (40) and a fifth shaft (80) for supporting the ratchet lever (78). Since each of the shafts has only one lever in this conventional latch device, the number of components is large so that the latch device can hardly be made to be compact.

A latch device disclosed in U.S. Pat. No. 5,035,453 comprises a first shaft (9) for supporting an outer opening lever (15) and a ratchet lever (12), a second shaft (58) for supporting an inner opening lever (60), a third shaft (68) for supporting a locking lever (52), and a fourth shaft for supporting a child-proof lever. In this conventional latch device, there is only one common shaft among these shafts.

Further, a latch device disclosed in U.S. Pat No. 4,492,395 discloses a first shaft (48) for supporting an outer opening lever (53), an inner opening lever (68) and a ratchet lever (47), a second shaft (85) for supporting a locking lever (81) and a third shaft (112) for supporting a child-proof lever (47). In this latch device, the first shaft supports three levers, but the remaining two shafts each support only one lever.

Further, a latch device disclosed in Japanese Laid-Open Patent No. 7-82939, as shown in FIG. 1, has a common shaft c for supporting an inner opening lever a and a child-proof lever b. However, the child-proof lever b in this latch device is not the one which is rotated around the common shaft c but is adapted to slide along an elongated hole d so as to be changed over between a child-proof position and a non-child proof position as shown in FIG. 2. Accordingly, the feeling of manipulation of the child-proof lever b is unsatisfactory.

SUMMARY OF THE INVENTION

An object of the present invention is, therefore, to provide a compact latch device in which levers in a locking mechanism and a child-proof mechanism are supported by a single shaft so that it can be manipulated satisfactorily.

Further, another object of the present invention is to provide a compact latch device in which levers in a door opening mechanism, a locking mechanism and a child-proof mechanism are supported by two shafts so that it can be manipulated satisfactorily.

BRIEF DESCRIPTION OF THE DRAWINGS

The above and other objects, features and advantages of the present invention will become apparent from the detailed description of the preferred embodiments that will be detailed hereinbelow with reference to the accompanying drawings in which:

FIG. 1 and 2 are views illustrating an inner opening lever and a child-proof lever of the prior art latch device;

FIG. 8 is a front view of a motorized actuator for changing over a locking lever;

FIG. 9 is a front view of a child-proof lever;

FIG. 10 is a front view of the locking lever;

FIG. 11 is a front view of an inner opening lever;

FIG. 12 is a front view of an outer opening lever;

FIG. 13 is a view of a ratchet lever;

PREFERRED EMBODIMENT OF THE INVENTION

Explanation will be hereinbelow made of an embodiment of the present invention with reference to the drawings.

Figure 3:
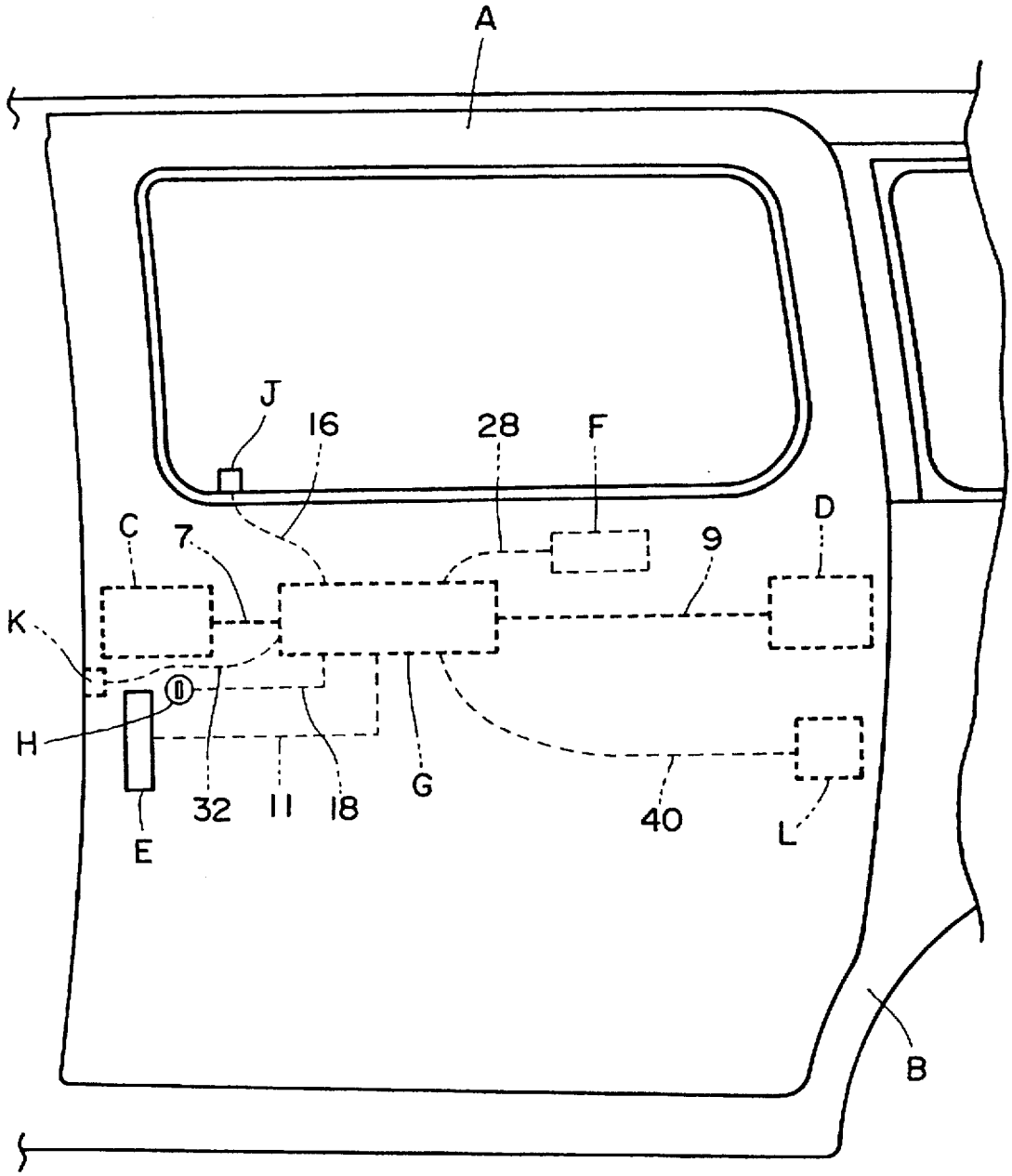
FIG. 3 is a view illustrating components provided on the sliding door.
Figure 4:
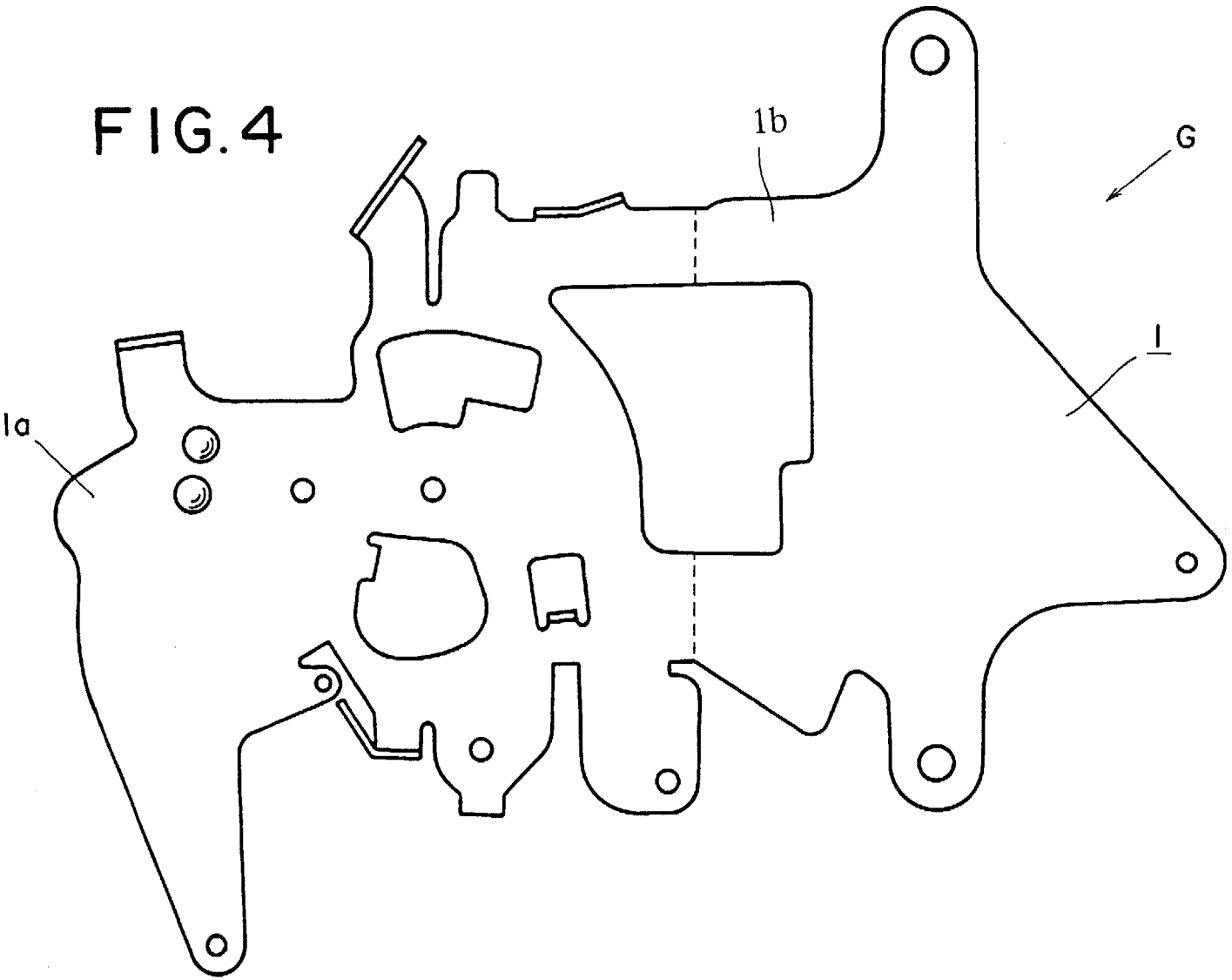
FIG. 4 is a front view of a base plate of a relay assembly.
Figure 18:
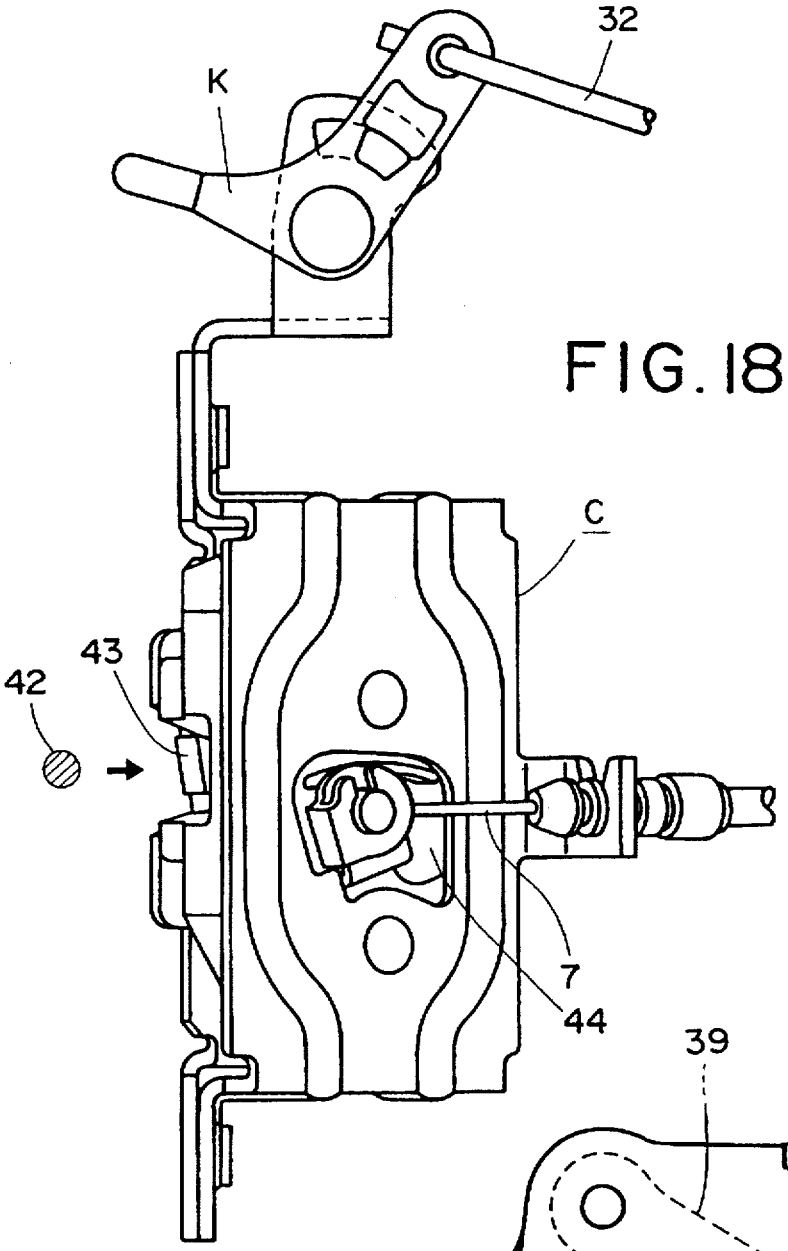
FIG. 18 is a side view of a front latch unit.
Figure 21:
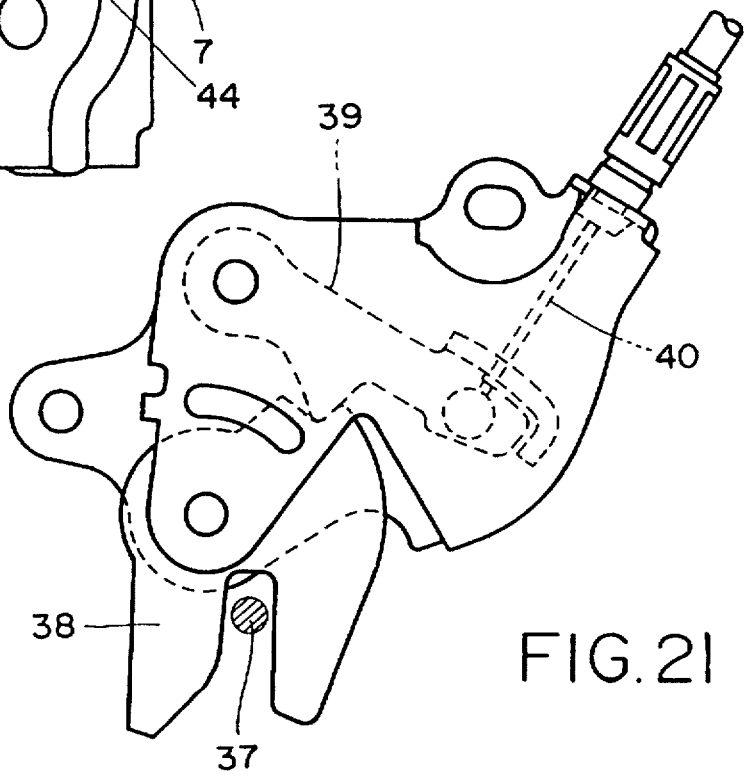
FIG. 21 is a front view of an open-position holder.
Figure 19:
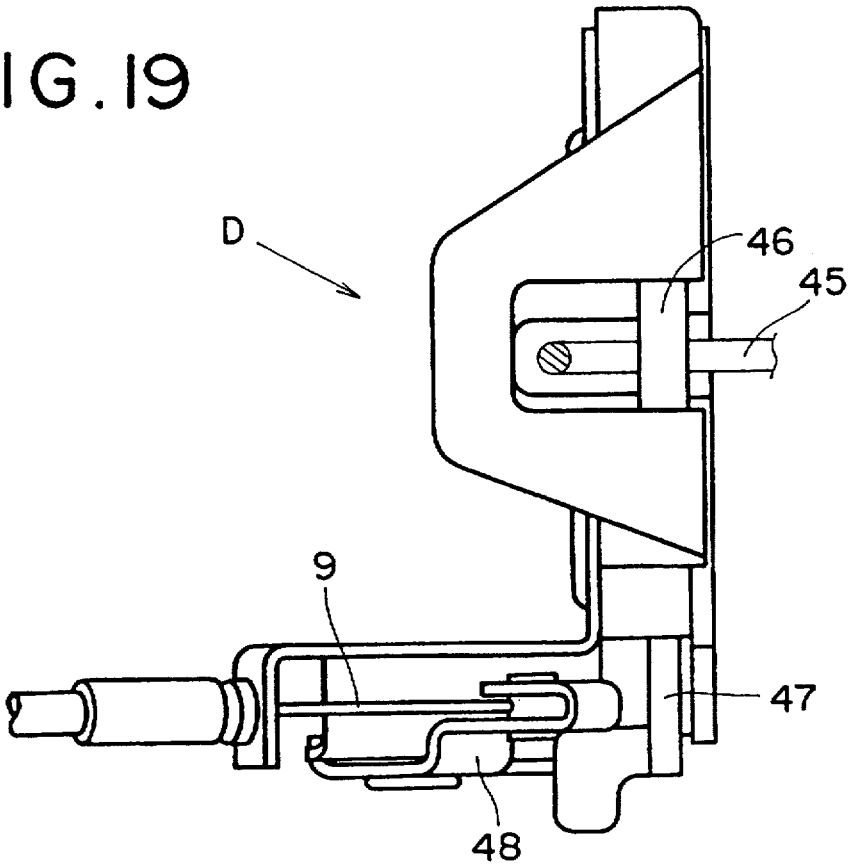
FIG. 19 is a side view of a rear latch unit.
Figure 20:
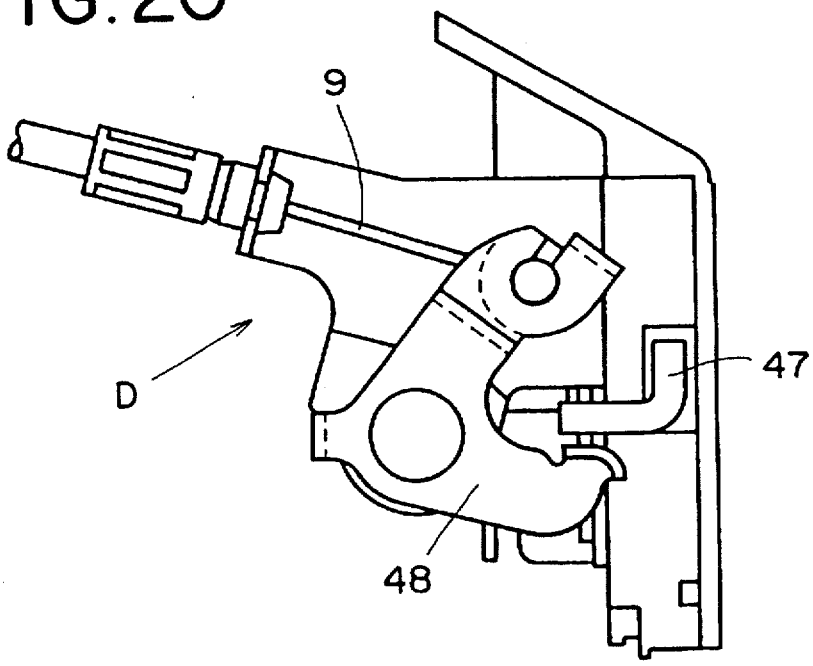
FIG. 20 is a bottom view of the rear latch unit.

Referring to FIG. 3, a vehicle sliding door A which is slidably attached to a vehicle body B comprises a front latch unit C provided at a front edge of the door A, a rear latch unit D provided at a rear edge of the door A, an outside open handle E provided at an outer surface of the door A, an inside open handle F provided at an inner surface of the door A, and a relay assembly G provided within the door A. As shown in FIG. 18, the front latch unit C comprises a latch 43 adapted to be engaged with a striker 42 secured to the vehicle body B, and a ratchet 44 adapted to be engaged with the latch 34 so as to hold the engagement between the latch 43 and the striker 42, and the rear latch unit D comprises, as shown in FIGS. 19 and 20, a latch 46 adapted to be engaged with a striker 45 secured to the vehicle body B, and a ratchet 47 adapted to be engaged with the latch 46 so as to hold the engagement between the latch 46 and the striker 45. Both latch units C, D hold the sliding door A at a closed position. It is noted that the front latch unit C may be omitted in a certain case.

The relay assembly G comprises a door opening mechanism, a locking mechanism and a child-proof mechanism which will be described in detail later. The relay assembly G is arranged between the two open handles E, F and the two latch units C, D, and manipulating force of both open handles E, F each is transmitted to both latch units C, D through the door opening mechanism of the relay assembly G.

The door A further has a key cylinder H which is provided at the outer surface thereof and coupled to the locking mechanism, an inside lock button J which is provided at the inner surface thereof and coupled to the locking mechanism, a child-proof button K which is provided at the front edge thereof and coupled to the child-proof mechanism, and an open-position holder L for holding the door A at a full-open position. It is noted that the key cylinder may be omitted in a certain case.

The relay assembly G is shown in detail in FIGS. 4 to 17 and has a metal base plate 1 fixed to a substantially center part of the sliding door A. The base plate 1 may be composed of a single metal plate or two metal plates 1*a*, 1*b* fixed together. In the case of using the two plates, the fundamental components of the relay assembly G would be attached to the main plate 1*a* while optional components of the relay assembly G would be attached to the sub plate 1*b*, so that if no optional components are required, the relay assembly G can be small-sized. In the present invention, for example, a motorized actuator 2 for releasing the open-position holder L is fixed to the plate 1*b* as an optional component.

Figure 5:
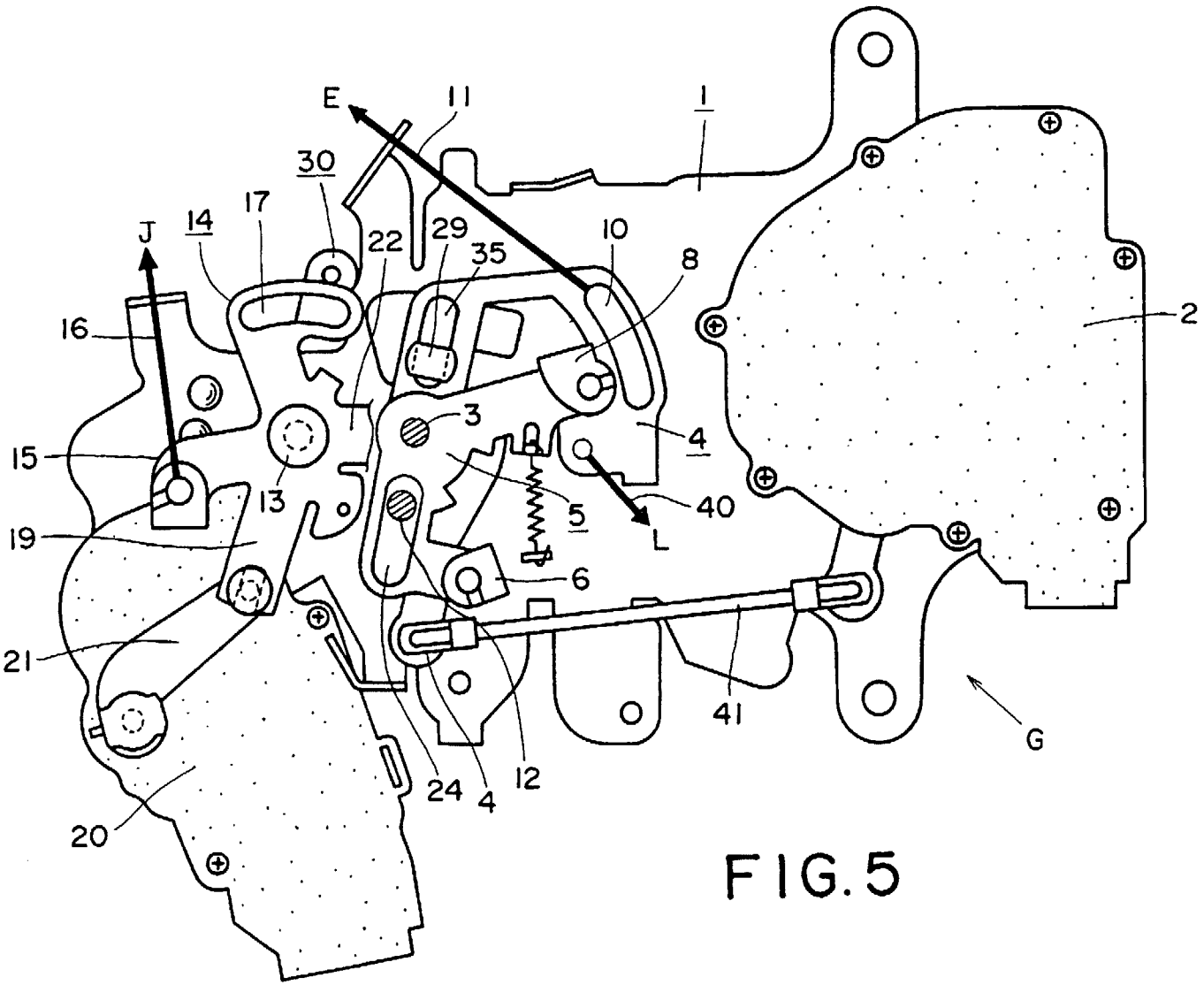
FIGS. 5 and 6 are a front view illustrating the relay assembly.
Figure 6:
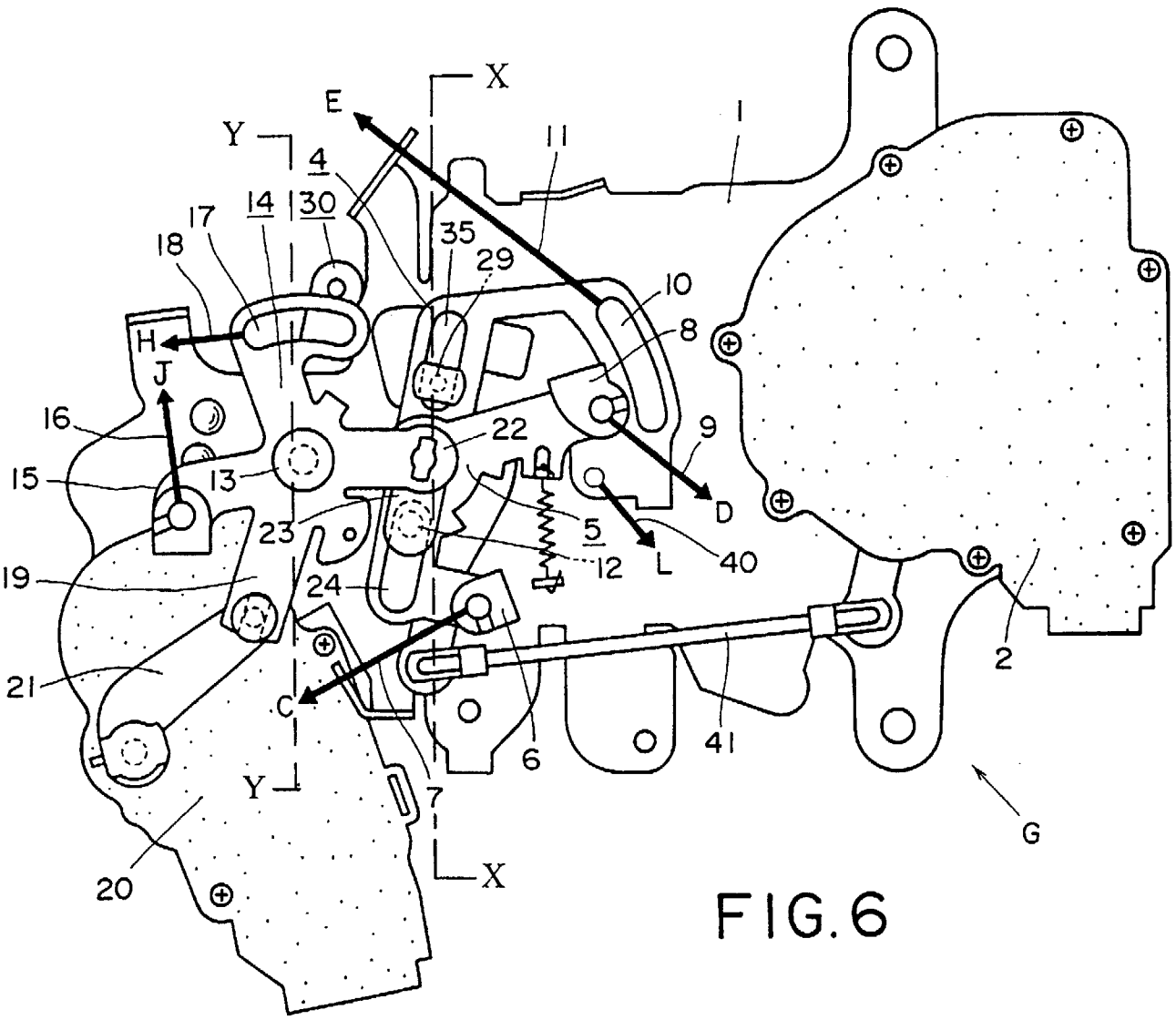
Figure 16:
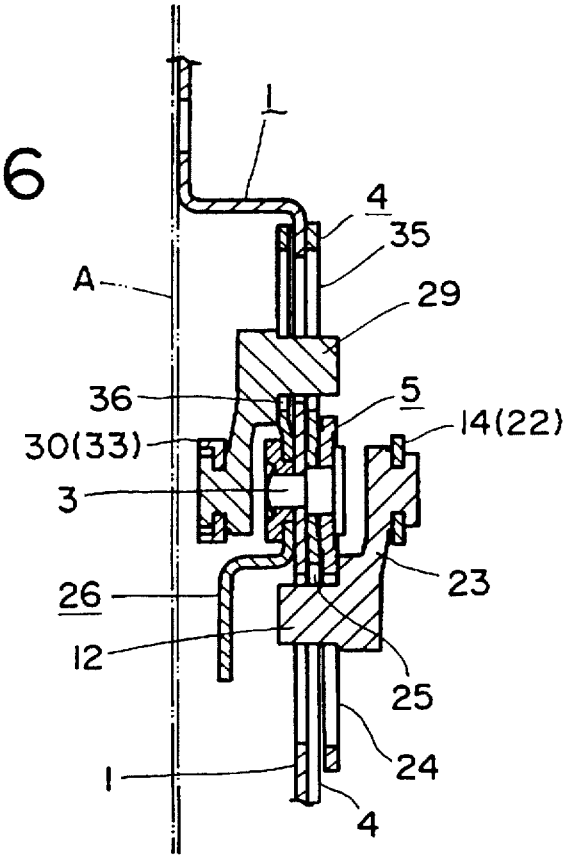
FIG. 16 is a sectional view along line X—X in FIG. 6.

As shown in FIGS. 5, 6 and 16, the door opening mechanism comprises an outer opening lever 4 and a ratchet lever 5, both of which are rotatably attached to a front side of the base plate 1 by a supporting shaft 3. A first arm 6 of the ratchet lever 5 is coupled to the ratchet 44 of the front latch unit C by way of a rod or a wire 7, and a second arm 8 of the ratchet lever 5 is coupled by way of a rod or a wire 9 to a lever 48 of the rear latch unit D which releases the ratchet 47 from the latch 45 when the ratchet lever 5 is rotated. A rod 11 has one end coupled to an elongated hole 10 of the outer opening lever 4 with a lost-motion and the other end coupled to the outside open handle E. The outer opening lever 4 and the ratchet lever 5 are coupled to each other through the intermediary of a locking pin 12 of the locking mechanism when the the locking mechanism is in a unlocked condition so that the latch units C, D are released by an opening operation of the outside open handle E. However, in such a case that the locking mechanism is in a locked condition, the rotational force of the outer opening lever 4 is not transmitted to the latch units C, D, and accordingly, the sliding door A cannot be opened.

Figure 17:
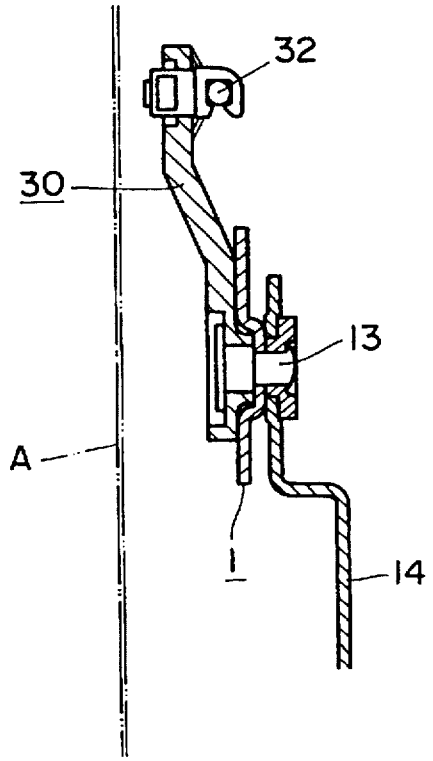
FIG. 17 is a sectional view along line Y—Y in FIG. 6.

The locking mechanism has a locking lever 14 which is rotatably attached to the front side of the base plate 1 through the intermediary of an attaching shaft 13 as shown in FIGS. 5, 6 and 17. A first arm 15 of the locking lever 14 is coupled to the inside lock button J by way of a rod or a wire 16. A rod 18 has one end coupled to an elongated hole 17 of the locking lever 14 with a lost-motion, and the other end coupled to the key cylinder H. A second arm 19 of the locking lever 14 is coupled to an outlet lever 21 of a motorized actuator 20 fixed to the base plate 1.

The locking lever 14 is changed over between the locked position and the unlocked position, as well-known, by means of the key cylinder H, the inside lock button J, or the motorized actuator 20. A third arm 22 of the locking lever 14 is extended toward the supporting shaft 3, and is superposed at its tip end with the supporting shaft 3 when the locking lever 14 is in the unlocked position. A slide link 23 has one end coupled to the tip end of the third arm 22, and the other end provided with the locking pin 12 which is slidably engaged in an elongated hole 24 formed in the first arm 6 of the ratchet lever 5. The pin 12 is further engaged with a hook 25 formed on the outer opening lever 4 when the locking lever 14 is in the unlocked position. Accordingly, in the unlocked condition, the rotation of the outer opening lever 4 is transmitted to the ratchet lever 5 through the intermediary of the pin 12. However, in the locked condition, the pin 12 is released from the hook 25, thereby the rotation of the outer opening lever 4 is not transmitted to the ratchet lever 5.

Figure 7:
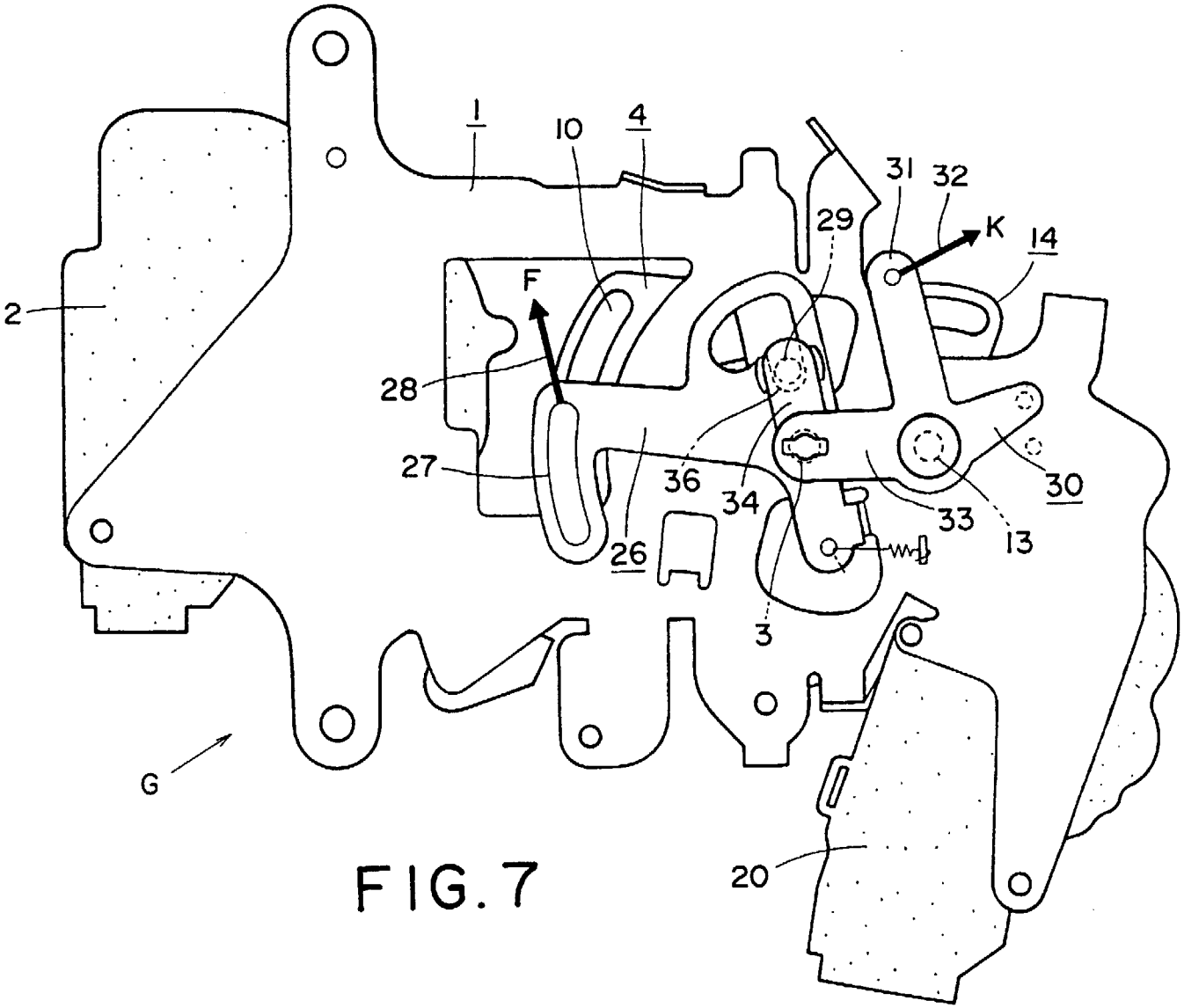
FIG. 7 is a rear view of the relay assembly.
Figure 14:
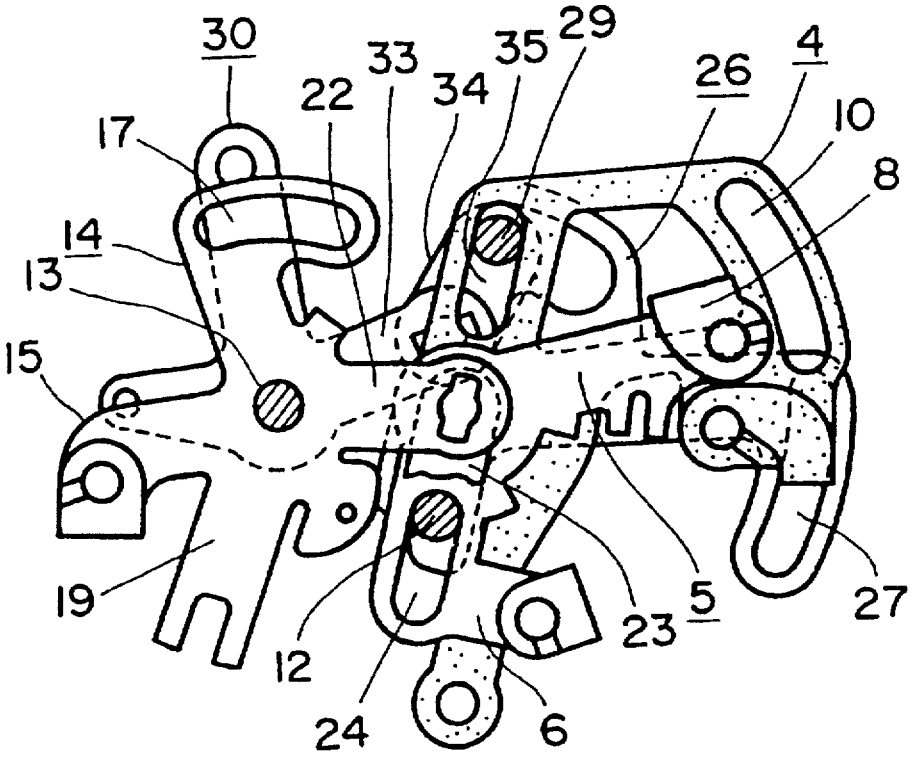
FIG. 14 is a status view illustrating an assembly of five levers.
Figure 15:
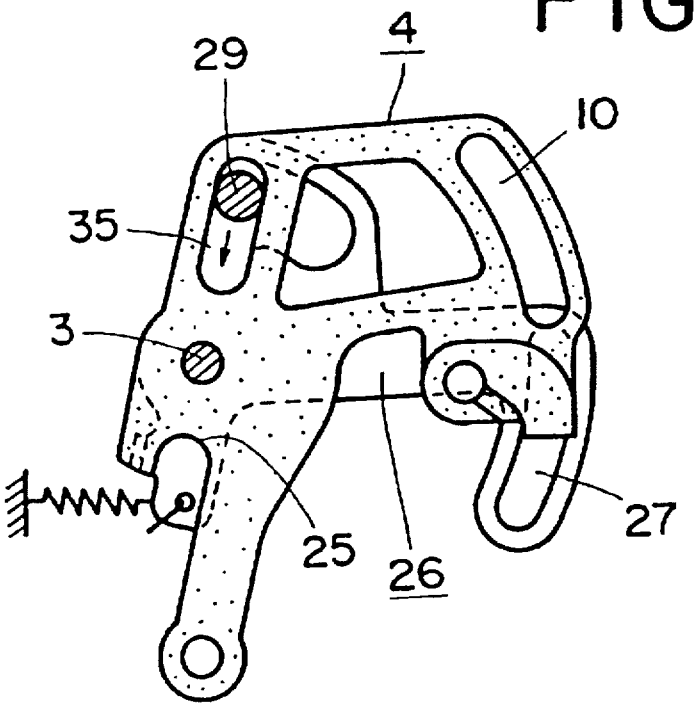
FIG. 15 is a front view illustrating the outer opening lever and the inner opening lever.

The door opening mechanism further includes an inner opening lever 26 rotatably attached to the rear or reverse side of the base plate 1 by means of the supporting shaft 3, as shown in FIGS. 7 and 16. An elongated hole 27 formed in the inner opening lever 26 is coupled to one end of a rod 28 with a lost-motion, the other end of which is coupled to the inside open handle F. The inner opening lever 26 and the outer opening lever 4 are connected together through the intermediary of a child pin 29 of the child-proof mechanism when the child-proof mechanism is in a non-child proof condition so that the outer opening lever 4 can be rotated by the inner opening lever 26. However, in such a case that the child-proof mechanism is in a child-proof condition, the rotational force of the inner opening lever 26 is not transmitted to the outer opening lever 4. Therefore, in the child-proof condition, the sliding door A cannot be opened from the inside of the passenger compartment of the vehicle.

The child-proof mechanism has a child-proof lever 30 which is rotatably attached to the rear side of the base plate 1 by means of the attaching shaft 13, as shown in FIGS. 7 and 17. A first arm 31 of the child-proof lever 30 is coupled to the child-proof button K provided at the front edge of the door through the intermediary of a rod or a wire 32. The child-proof lever 30 is changed over, as well-known, between the child-proof position and the non-child proof position by a manipulating force of the button K. A second arm 33 of the child-proof lever 30 is extended toward the supporting shaft 3 so as to be superposed with the shaft 3 when the child-proof lever 30 is in the non-child proof position. A slide link 34 has one end coupled to the tip end of the second arm 33, and the other end provided with the child pin 29 which is slidably engaged in an elongated hole 35 formed in the outer opening lever 4. Further, the pin 29 is engaged with a hook 36 formed on the inner opening lever 26 when the child-proof lever 30 is in the non-child-proof position. Accordingly, the rotational force of the inner opening lever 26 is transmitted to the outer opening lever 4 through the intermediary of the pin 29 in the non-child-proof condition. However, in the case of the child-proof condition, the pin 29 is released from the hook 36, and accordingly, the rotation force of the inner opening lever 26 is not transmitted to the outer opening lever 4.

The open-position holder L for holding the door A at the full-open position comprises a latch 38 which is engaged with a striker 37 fixed to the vehicle body B when the sliding door A is moved to the full-open position, and a ratchet 39 for holding the engagement between the latch 38 and the striker 37. The ratchet 39 is coupled to the outer opening lever 4 through the intermediary of a rod or a wire 40. Thus, when the open handle E or F of the door A is gripped so as to pull the door A toward its closed position, the handle E or F inevitably rotates the opening lever 4 to release the ratchet 39 from the latch 38. As a result, the door A is made to be free so that the door A can be moved toward its closed position.

The actuator 2 is coupled to the opening lever 4 through the intermediary of a rod 41, and accordingly, the actuator 2 can release the holder L through the intermediary of the open lever 4.

As mentioned above, according to the present invention, three levers of the door opening mechanism which consist of the two opening levers 4, 26 and the ratchet lever 5, are journalled to the base plate 1 by means of the single supporting shaft 3, and further, two levers consisted of the locking lever 14 of the locking mechanism and the child-proof lever 30 of the child-proof mechanism, are rotatably journalled to the base plate 1 by means of the single attaching shaft 13. Thus, a plurality of levers can efficiently be attached to the base plate 1, and accordingly, the relay assembly G can be made to be small-sized. Further, the child-proof lever 30 is changed over between the child-proof position and the non-child-proof position by rotating about the attaching shaft 13, and accordingly, the feeling of the manipulation can be satisfactory.

Further, according to the present invention, since the ratchet 39 of the open-position holder L is coupled to the outer opening lever 4, the mechanism for opening and closing the door A can be integrated in the relay assembly G in a compact configuration.

What is claimed is:

1. In a vehicle sliding door having a latch unit provided at a rear edge of the sliding door for maintaining a closed condition of the sliding door, an outside open handle provided on an outer surface of the sliding door, an inside open handle provided on an inner surface of the sliding door, a relay assembly provided within the sliding door for connecting the outside and inside open handle to the latch unit, an inside lock button provided on the inner surface of the sliding door, and a child-proof button provided on the sliding door, said relay assembly comprising:

a base plate fixed to the sliding door;

an outer opening lever rotatably mounted on the base plate and coupled to the outside open handle and the latch unit to release the latch unit when the outside open handle is operated;

a locking lever rotatably mounted on the base plate and coupled to the inside lock button, said locking lever having an unlocked position in which the locking lever interconnects the outer opening lever and the latch unit and a locked position in which the locking lever disconnects the outer opening lever and the latch unit;

an inner opening lever rotatably mounted on the base plate and coupled to the inside open handle and the outer opening lever to rotate the outer opening lever when the inside open handle is operated;

a child-proof lever rotatably mounted on the base plate and coupled to the child-proof button, said child-proof lever having a non-child-proof position in which the child-proof lever interconnects the inner opening lever and the outer opening lever and a child-proof position in which the child-proof lever disconnects the inner opening lever and the outer opening lever;

wherein said locking lever and said child-proof lever are pivotally mounted on the base plate by a first shaft.

2. The sliding door according to claim 1, wherein said locking lever and said child-proof lever are provided on opposite sides of the base plate, respectively.

3. The sliding door according to claim 1, wherein said outer opening lever is connected with an open-position holder provided on the sliding door.

4. The sliding door according to claim 1, wherein said inner opening lever and said outer opening lever are pivotally mounted on the base plate by a second shaft parallel to the first shaft.

5. The sliding door according to claim 4, wherein said inner opening lever and said outer opening lever are provided on opposite sides of the base plate, respectively.

6. The sliding door according to claim 4, wherein said inner opening lever and said child-proof lever are provided on one side of the base plate, and said locking lever and said outer opening lever are provided on the other side of the base plate.

7. The sliding door according to claim 4, wherein said outer opening lever is connected with an open-position holder provided on the sliding door.

8. The sliding door according to claim 4, further comprising a ratchet lever rotatably mounted on the base plate and coupled to the latch unit through a rod or wire, said locking lever having a locking pin which transmits rotational force of the outer opening lever to the ratchet lever when in the unlocked position, and which does not transmit the rotational force of the outer opening lever to the ratchet lever when in the locked position.

9. The sliding door according to claim 8, wherein said ratchet lever is pivotally mounted on the base plate by the second shaft.

10. The sliding door according to claim 8, wherein said outer opening lever is connected with an open-position holder provided on the sliding door.

* * * * *